US005619980A

United States Patent [19]

Lee et al.

[11] Patent Number: 5,619,980

[45] Date of Patent: Apr. 15, 1997

[54] PLAY MATERIAL SHOOTING TOY

[75] Inventors: Sean S. Lee, Hermosa Beach; Mark Barthold, Redondo Beach, both of Calif.

[73] Assignee: Mattel, Inc., El Segundo, Calif.

[21] Appl. No.: 518,437

[22] Filed: Aug. 23, 1995

Related U.S. Application Data

[63] Continuation-in-part of Ser. No. 292,914, Aug. 19, 1994, abandoned.

[51] Int. Cl.[6] ..... F41B 11/24

[52] U.S. Cl. ..... 124/64; 124/56; 446/100; 446/198; 446/486

[58] Field of Search ..... 124/56, 63, 64, 124/65; 446/100, 183, 197, 198, 486

[56] References Cited

U.S. PATENT DOCUMENTS

| | | | |
|---|---|---|---|
| 964,810 | 7/1910 | Rieger | 124/65 |
| 1,033,094 | 7/1912 | Fuda | 124/64 |
| 3,074,720 | 1/1963 | Carver et al. | 273/85 E |
| 3,353,823 | 11/1967 | Sobel | 124/64 X |
| 3,513,819 | 5/1970 | Phillips | 124/64 |
| 3,577,676 | 5/1971 | Powell | 124/64 X |
| 3,744,472 | 7/1973 | O'Ryan | 124/64 X |
| 3,870,304 | 3/1975 | Minnick | 124/6 |
| 3,903,865 | 9/1975 | Kaneko | 124/64 |
| 4,159,705 | 7/1979 | Jacoby | 124/63 |
| 4,630,756 | 12/1986 | Amici et al. | 222/78 |
| 4,689,033 | 8/1987 | Droller et al. | 124/64 X |
| 5,205,773 | 4/1993 | Koepcke et al. | 446/183 |

*Primary Examiner*—John A. Ricci
*Attorney, Agent, or Firm*—Roy A. Ekstrand

[57] ABSTRACT

A play material shooting toy utilizes a housing supporting a face element having a mouth aperture formed therein. The face element is removable from the housing and may receive a plug of amorphous play material. The housing further defines a collapsible bellows portion which facilitates the creation of pressurized air within the housing as the bellows are collapsed by the user's hand. The play material plug within the face unit may be launched or shot from the housing by replacing the loaded face unit into the housing and thereafter rapidly collapsing the bellows to pressurize the air within the housing and launch the plug of play material.

10 Claims, 2 Drawing Sheets

PLAY MATERIAL SHOOTING TOY

CROSS-REFERENCE TO RELATED APPLICATION

This application is a continuation-in-part of application entitled Play Material Shooting Toy filed Aug. 19, 1994 in the name of Sean S. Lee and Mark Barthold having Ser. No. 08/292,914 now abandoned, which is assigned to the assignee of the present application.

FIELD OF THE INVENTION

This invention relates generally to shooting toys and particularly to those utilizing a compressible air power source for imparting energy to the projectile.

BACKGROUND OF THE INVENTION one of the most popular types of toys enjoyed by a wide variety of children through the years may be generally described as projectile shooting or launching toys. In attempting to meet this consumer popularity and demand, practitioners in the art have provided a variety of projectile launching and shooting toys. Such toys have included various rocket or missile type launching toys as well as those accelerating or launching toy vehicles and spherical objects such as ping-pong or foam balls or the like. One of the most convenient and readily available mechanisms for providing the pressurized air necessary to launch such projectiles and the like is provided by a resilient collapsible bellows or bulb. In this type of toy apparatus, the user is able to impart substantial energy to the projectile by simply manually manipulating or collapsing the air bellows. The resilient structure of the air bellows facilitates its restoration to the normal state upon release by the child user.

For example, U.S. Pat. No. 5,205,773 issued to Koepcke, et al. sets forth a DEFORMABLE TOY STRUCTURE WITH INVERTED MOUTH having a squeeze toy defining a generally resilient outer body which in turn defines a main cavity. A portion of the body extends inwardly into the main cavity to form a receptacle. The receptacle includes a mouth which is dimensioned to enable a projectile to be inserted therein and to be supported within the mouth. The receptacle has a configuration which normally causes an interference fit with the projectile to retain the projectile within the mouth. The body of the squeeze toy may be deformed to cause a portion of the receptacle to be forced outward through the mouth thereby ejecting the projectile from the body.

U.S. Pat. No. 4,159,705 issued to Jacoby sets forth a TOY PROJECTILE LAUNCHING DEVICE having a projectile launching barrel within which a plunger is situated and having a coupling secured to a resilient inflatable air reservoir. A squeezable hand bulb is coupled to the valve mechanism to allow inflation of the flexible resilient reservoir to provide a source of air pressure to be applied to a projectile within the projectile launcher.

U.S. Pat. No. 3,903,865 issued to Kaneko sets forth an AIR POPPER comprising a hollow drum having a funnel-shaped projecting portion extending upwardly therefrom. The drum portion further supports a plurality of rolled tapes while the funnel portion receives a projectile. As the projectile is launched, the tapes are discharged from the drum portion.

U.S. Pat. No. 3,577,676 issued to Powel sets forth a STRIP PROJECTING SQUEEZE TOY having an elongated flexible element disposed within a squeezable animal body.

A substantial length of the flexible element is projected from the body through an opening within the body such as a mouth as the animal body is squeezed.

U.S. Pat. No. 3,870,304 issued to Minnick sets forth an INFLATABLE STRIKING MEMBER AND PROJECTILE DISPENSING RECEPTACLE having a game device formed of an inflatable plastic or the like and having a projectile receiving receptacle supported by an upper surface of the structure. The parts of the structure are so arranged and constructed that projectiles within the receptacle are ejected therefrom when a portion of the inflatable structure receives a blow remote from the receptacle.

U.S. Pat. No. 3,353,823 issued to Sobel sets forth a PNEUMATIC SQUEEZE TOY having a bottle-like squeezable receptacle formed of a resilient material. The neck aperture of the receptacle supports a projectile having an elongated filament passing through the receptacle mouth and secured at the remaining end within the receptacle. Squeezing the bottle receptacle launches the projectile drawing the filament outwardly. In an alternate embodiment, the receptacle is configured to generally resemble a frog.

U.S. Pat. No. 4,630,757 issued to Amici, et al. sets forth a LIQUID SQUIRTING CREATURE having a body defining a front section, legs and head and a rear section assembled thereto. The front section is comprised of top and bottom elements defining a cavity therebetween having apertures formed therein. The rear section is a bulbous resiliently compressible member. A hollow tube extends from the bulbous rear portion through the apertures in the front portion and outwardly. When the bulbous portion is squeezed, a spray of liquid within the bulbous portion is squirted out through the tube in the front body section.

U.S. Pat. No. 1,033,094 issued to Fuda sets forth a TARGET AIR GUN having an elongated barrel supporting a projectile receiving funnel coupled to a collapsible resilient bulb. The resilient bulb is received within a fixture having a movable plunger for compressing the bulb. As the plunger is forced against the bulb, the collapsing bulb produces a burst of compressed air launching the projectile.

U.S. Pat. No. 3,074,720 issued to Carver, et al. sets forth a TOY SIMULATING PART OF A BASKETBALL GAME having a support base and a vertically extending wall which in turn supports a basketball hoop. A movable pedestal supporting a simulated basketball player is supported upon the base. Means are provided for launching a ball from the player toward the hoop with the object of passing the ball through the hoop.

Despite the wide variety of projectile and other object launching toys, there remains nonetheless a continuing need in the art for evermore interesting, improved and amusing toys and toy playsets which provide object launch or shooting.

SUMMARY OF THE INVENTION

Accordingly, it is a general object of the present invention to provide an improved toy having the capability of launching a play object. It is a more particular object of the present invention to provide an improved launching type toy which is able to project a quantity of an amorphous play material in an amusing play pattern.

In accordance with the present invention, there is provided a play material shooting toy comprises: a hollow housing having a collapsible portion and defining an aperture therein; a play material sleeve removably securable to the housing and at least partially received within the aperture, the sleeve defining a bore therein; and a quantity of amorphous play material, the sleeve being applied to the play material so as to lodge a plug of play material within the bore and thereafter reinstalled in the aperture and the hollow housing being rapidly collapsed to pressurize the air within the hollow housing and expel the plug of play material.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENT

Figure 1:
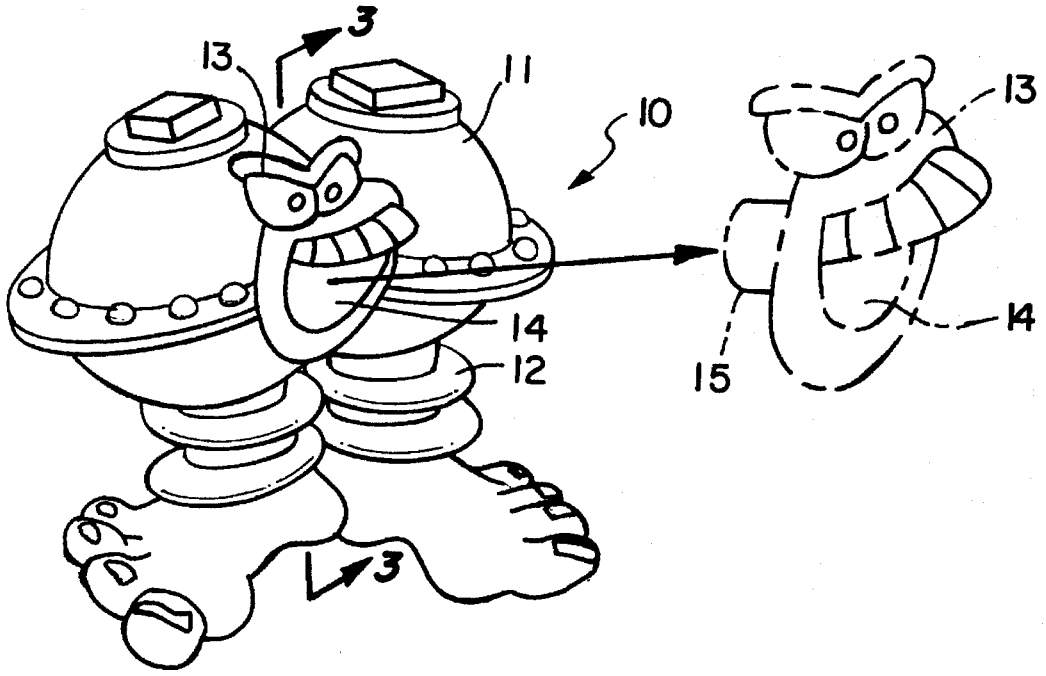
FIG. 1 sets forth a perspective view of a play material shooting toy constructed in accordance with the present invention.

FIG. 1 sets forth a perspective view of a play material shooting toy constructed in accordance with the present invention and generally referenced by numeral 10. Play material shooting toy 10 includes a housing 11 formed in a fanciful replication of a robot-like creature and having a collapsible bellows 12 coupled to a supporting base 16. In the particular design of housing 11 shown in FIG. 1, bellows 12 forms a joined pair of generally cylindrical collapsible bellows each coupled to a respective portion of a support base 16 which replicates exaggerated or fanciful "feet". Housing 11 further defines an insert 22 (seen in FIG. 3) which in turn receives and supports a face 13. As is set forth below in greater detail, face 13 defines a cylindrical sleeve 15 received within insert 22 (seen in FIG. 3) and defining a mouth aperture 14 extending therethrough. In the position shown in FIG. 1, face 13 is shown secured to housing 11.

In accordance with the present invention, face 13 is removable in the manner shown in FIG. 1 by simply drawing face 13 away from housing 11.

Figure 2:
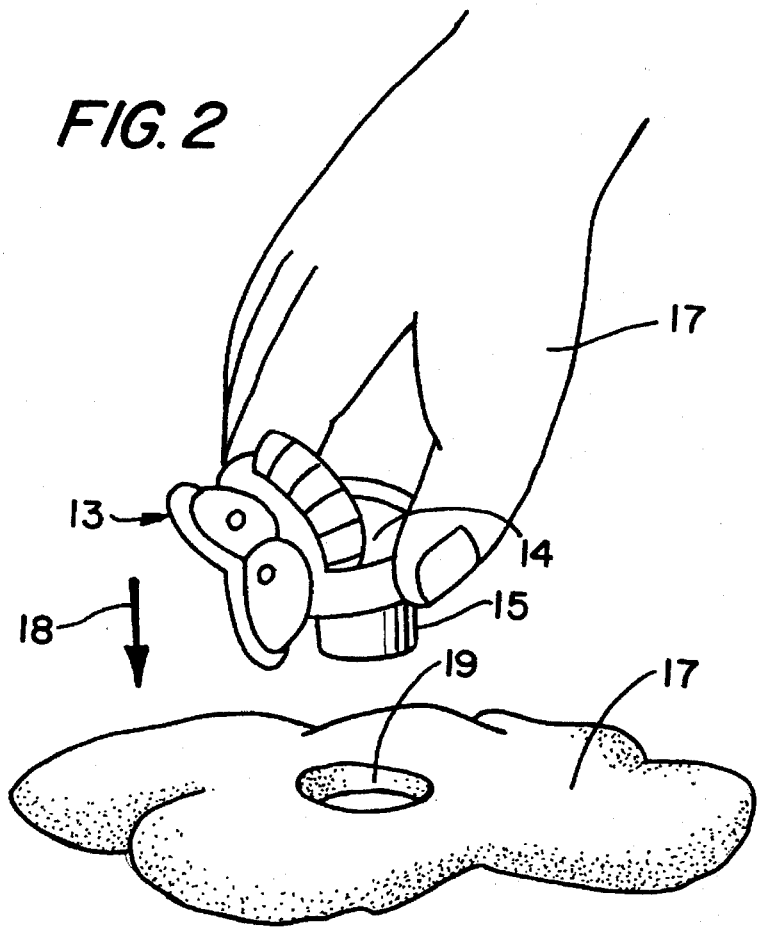
FIG. 2 sets forth a perspective view of the loading operation for the present invention play material shooting toy.

FIG. 2 sets forth the operation of loading the present invention play material toy with a quantity of play material. Accordingly with face 13 removed from housing 11, the user simply grasps face 13 using hand 17 such that sleeve 15 is pointed downwardly. Additionally, a quantity of amorphous play material 17 is placed upon a convenient surface and thereafter sleeve 15 of face 13 is forced through play material 17 in a "cookie cutter" like motion in which an aperture 19 is formed in play material 17 as sleeve 15 is withdrawn therefrom. This operation forces a quantity of play material 17 into mouth aperture 14 of sleeve 15. The resilient character of play material 17 causes the quantity of play material within sleeve 15 to form a play material plug 20 (seen in FIG. 3).

Figure 3:
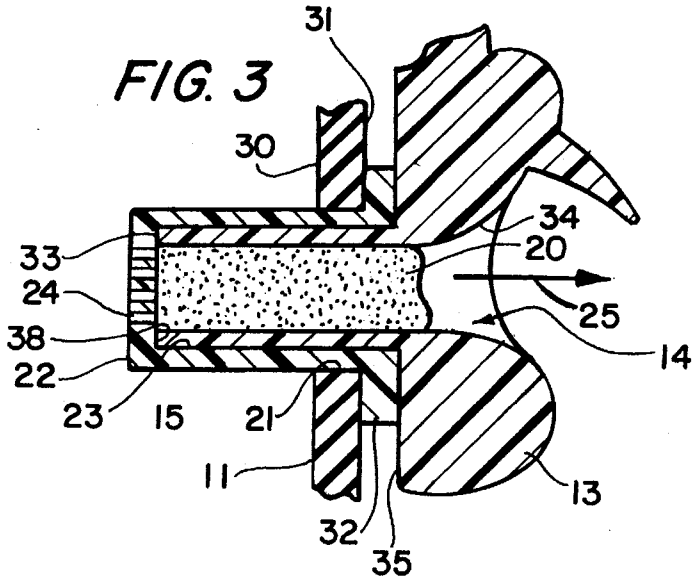
FIG. 3 sets forth a partial section view of the present invention play material shooting toy taken along section lines 3—3 in FIG. 1.

FIG. 3 sets forth a section view of toy 10 taken along section lines 3—3 in FIG. 1. As described above, housing 11 defines an aperture 21 which receives a generally cylindrical insert 22 secured therein in accordance with conventional fabrication techniques such as adhesive or welding. Insert 22 defines a cylindrical bore 23 and a closed end having a plurality of smaller apertures 24 formed therein. Face 13 is oriented with respect to insert 22 such that cylindrical sleeve 15 is aligned with bore 23 of insert 22. As described above, a quantity of play material forms a play material plug 20 within mouth aperture 14 of sleeve 15. Thus, face 13 is inserted into insert 22 such that sleeve 15 is received within bore 23 carrying material plug 20 to the position shown in FIG. 3. As will be apparent from examination of FIG. 3, the creation of a high pressure air volume within housing 11 is communicated through apertures 24 to material plug 20 and propels material plug 20 outwardly through mouth aperture 14 in the direction indicated by arrow 25.

Housing 11 defines an outside surface 31 and an inside surface 30 through which aperture 21 extends. Insert 22 is received within aperture 21 as described above and includes an outwardly extending lip 32 which is seated against outside surface 31 of housing 11. Insert 22 further defines a base area 38 surrounding apertures 24 in the bottom portion of insert 22. Correspondingly, sleeve 15 of face portion 13 defines a bottom edge 33 and an undersurface 35. In the preferred fabrication of the present invention, the length of sleeve 15 extending from undersurface 35 to bottom edge 33 is substantially the same as the distance from the outer surface of lip 32 to base 38. As a result, the contact of bottom edge 33 of sleeve 15 against base portion 38 of insert 22 provides a generally tight air seal whereby the pressurized air force coupled to material plug 20 through apertures 24 as housing 11 is squeezed is maximally applied to material plug 20. This provides effective launching of material plug 20. In addition, mouth aperture 14 preferably forms an outwardly tapered funnel-like surface 34. Surface 34 aids in the separation of material plug 20 from the interior surface of mouth aperture 14. This further improves the plug launching characteristics of the present invention toy.

Figure 4:
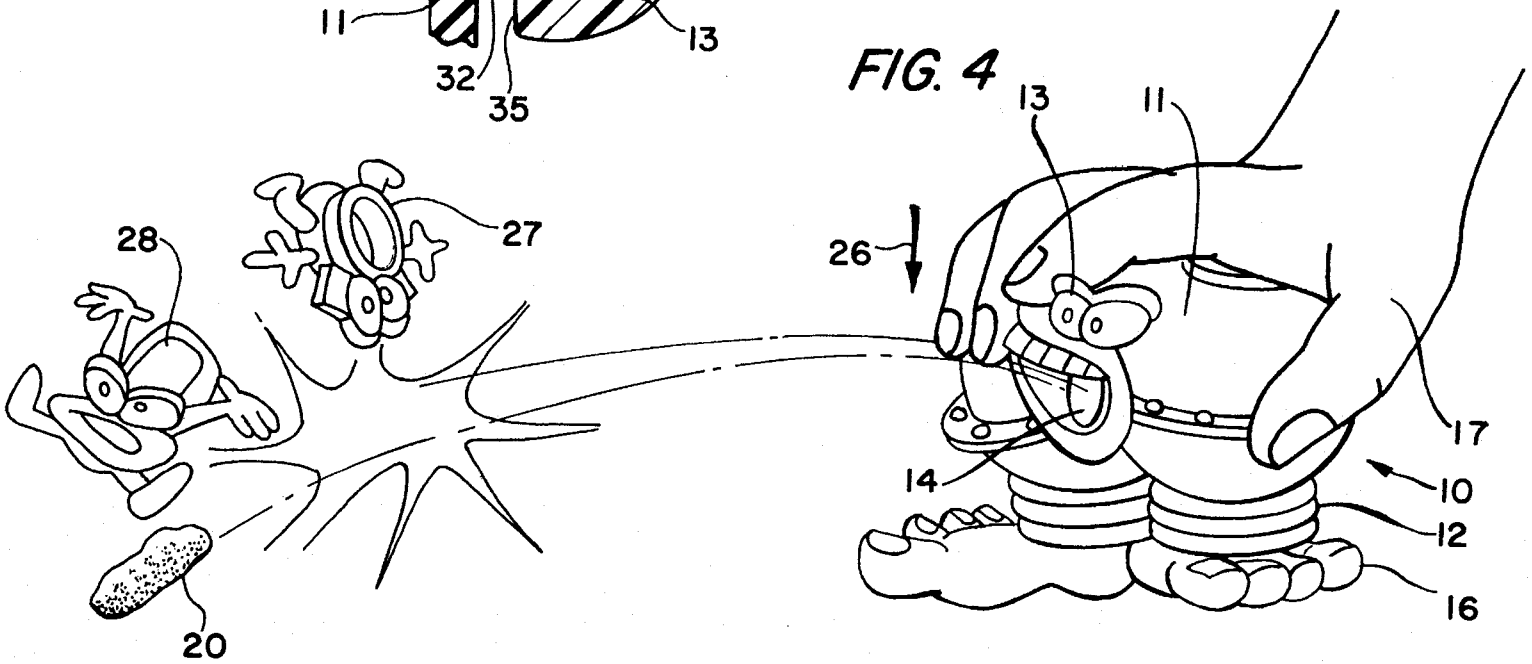
FIG. 4 sets forth a perspective view of the present invention play material shooting toy in a typical shooting operation.

FIG. 4 sets forth a typical use of the present invention play material shooting toy having a material plug 20 loaded within sleeve 15 of face 13 in the manner described above. Thus, with face 13 replaced upon housing 11, the user simply grabs housing 11 using hand 17 and forces downwardly in a rapid abrupt motion in the direction of arrow 22 collapsing bellows 12. The rapid collapse of bellows 12 upon base 16 forms the above-described high pressure air volume within housing 11 forcing material plug 20 outwardly through mouth aperture 14 as shown in FIG. 4. For further play value and amusement, a plurality of targets such as targets 27 and 28 may be utilized in combination with the present invention play material shooting toy for further enhancement.

Once toy 10 has launched the material plug within face 13, the above operation is repeated in which face 13 is removed from housing 11 and in the manner shown in FIG. 2 an additional plug of play material is inserted into sleeve 15. Thereafter, face 13 is replaced and toy 10 is again ready to launch a play material plug.

In accordance with an important aspect of the present invention, the shooting of an amorphous play material by the present invention toy provides a substantial improvement in play amusement value and safety in that the "projectile" provided by the amorphous play material plug is virtually free of any hazard potential and thus may be safely launched for substantial distances.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. A play material toy comprising:

a quantity of amorphous play material;

a hollow housing having a collapsible portion and defining an aperture therein; and means for forming a plug of said play material including a play material sleeve removably securable to said housing and at least partially received within said aperture, said sleeve defining a bore therein, said sleeve being applied to said play material so as to form and lodge a plug of play material within said bore and thereafter reinstalled in said aperture and said hollow housing being rapidly collapsed to pressurize the air within said hollow housing and expel said plug of play material.

2. A play material toy as set forth in claim 1 wherein said play material sleeve defines a generally tapered surface extending outwardly from said bore.

3. A play material toy as set forth in claim 2 wherein said aperture is generally circular and wherein said sleeve is generally cylindrical.

4. A play material toy as set forth in claim 3 wherein said hollow housing includes an upper portion, defining said aperture, a collapsible bellows portion extending downwardly therefrom and a base supporting said bellows.

5. A play material toy as set forth in claim 4 further including an insert having an insert bore formed therein received within said aperture and wherein said sleeve is received within said insert bore, said insert being fixedly secured to said housing.

6. A play material toy as set forth in claim 5 wherein said insert defines an interior closed end having a plurality of vent apertures formed therein.

7. A play material toy as set forth in claim 1 further including an insert having an insert bore formed therein received within said aperture and wherein said sleeve is received within said insert bore, said insert being fixedly secured to said housing.

8. A play material toy as set forth in claim 7 wherein said insert defines an interior closed end having a plurality of vent apertures formed therein.

9. A play material toy comprising:

a pressurizable housing defining an interior cavity and a collapsible portion for pressurizing said interior cavity and an aperture communicating with said interior cavity;

a quantity of amorphous play material; and means for forming a plug of play material from said quantity of amorphous play material including a sleeve member removably receivable within said aperture having an inner edge, an outer edge and a bore therebetween, said sleeve member receiving and forming a plug of amorphous play material cut from said quantity of amorphous play material by forcing said inner edge of said sleeve against said quantity of amorphous play material, said sleeve being placed within said aperture and said housing being squeezed at said collapsible portion to pressurize said interior cavity and expel said plug from said bore.

10. A method of playing an amorphous-material plug-shooting game comprising the steps of:

providing a pressurizable housing having a collapsible portion and an aperture formed therein;

providing a quantity of amorphous play material;

providing a plug shooting member having a sleeve and an open plug bore therein;

removably supporting said plug shooting member within said aperture;

removing said plug shooting member from said aperture;

forcing said sleeve into said amorphous play material to separate a portion of said play material from said quantity of amorphous play material and form a plug within said plug bore;

installing said plug shooting member, bearing said plug in said plug bore, into said aperture; and rapidly collapsing at least a portion of said housing to force said plug from said plug bore.

* * * * *